US008784119B2

(12) United States Patent
Tseng et al.

(10) Patent No.: US 8,784,119 B2
(45) Date of Patent: Jul. 22, 2014

(54) ELECTRICAL CONNECTOR

(75) Inventors: Ting Chang Tseng, Taipei (TW); Wen Lung Lin, Taipei (TW)

(73) Assignee: Bing Xu Precision Co. Ltd., Taipei (TW)

( * ) Notice: Subject to any disclaimer, the term of this patent is extended or adjusted under 35 U.S.C. 154(b) by 244 days.

(21) Appl. No.: 13/478,792

(22) Filed: May 23, 2012

(65) Prior Publication Data

US 2012/0315800 A1 Dec. 13, 2012

(51) Int. Cl.

| | |
|---|---|
| ***H01R 12/00*** | (2006.01) |
| ***H01R 12/63*** | (2011.01) |
| ***H01R 12/61*** | (2011.01) |

(52) U.S. Cl.

CPC ..... *H01R 12/63* (2013.01); *H01R 12/61* (2013.01)

USPC ..... 439/67; 439/77; 439/495

(58) Field of Classification Search

CPC ..... H01R 12/61; H01R 12/63

USPC ..... 439/495, 67, 77

See application file for complete search history.

(56) References Cited

U.S. PATENT DOCUMENTS

| | | | | | |
|---|---|---|---|---|---|
| 4,707,914 | A * | 11/1987 | Schauer | 29/872 |
| 5,045,641 | A * | 9/1991 | Urushibata et al. | 174/74 R |
| 5,231,758 | A * | 8/1993 | Schauer | 29/856 |
| 5,683,259 | A * | 11/1997 | Sato | 439/164 |
| 5,724,730 | A * | 3/1998 | Tanaka | 29/868 |
| 5,780,774 | A * | 7/1998 | Ichikawa et al. | 174/88 R |
| 5,944,553 | A * | 8/1999 | Yasui et al. | 439/495 |
| 6,376,773 | B1 * | 4/2002 | Maegawa | 174/88 R |
| 6,386,905 | B1 * | 5/2002 | Ito | 439/495 |
| 7,815,459 | B2 | 10/2010 | Chen et al. | |
| 2003/0064625 | A1 * | 4/2003 | Ozai | 439/579 |
| 2008/0102656 | A1 * | 5/2008 | Lin et al. | 439/77 |
| 2012/0315800 | A1 * | 12/2012 | Tseng et al. | 439/676 |

FOREIGN PATENT DOCUMENTS

| | | |
|---|---|---|
| TW | 348367 | 1/2009 |

* cited by examiner

*Primary Examiner* — James Harvey
(74) *Attorney, Agent, or Firm* — Mark M. Friedman

(57) ABSTRACT

An electrical connector is provided with an FFC including a first insulating layer including a plurality of internal flat conductors each being elongated and having an exposed contact portion at one end and an exposed soldering portion at the other end; an electrical cable including a plurality of conductors each having a second insulating layer therearound, the conductors electrically connected to the soldering portions; and a connector housing covering a rear portion of the FFC and a front end of the electrical cable for fastening the FFC and the electrical cable. A front portion of the FFC is provided with a protective plastic plate for fastening and supporting the contact portions of the FFC and the first insulating layer.

19 Claims, 13 Drawing Sheets

ELECTRICAL CONNECTOR

BACKGROUND OF THE INVENTION

1. Field of the Invention

The invention relates to electrical connectors and more particularly to an electrical connector comprising a FFC (flex flat cable), an electrical cable electrically connected to the FFC, and a protective plastic plate in front of the FFC.

2. Description of Related Art

Taiwan Patent Publication No. M348,367 (its corresponding patents being China Patent No. 201266719 and U.S. Pat. No. 7,815,459) entitled "Cable connector assembly having a spacer and a bracket" disclosed a cable connector assembly comprising an insulating housing defining a base portion and a mating portion; a plurality of contacts received in the insulating housing and arranged in a line transversely; a cable connected to the contacts electrically; a cover made of an insulating material and mating with the insulating housing. The cover is attached to the base portion of the insulating housing. The cover and the mating portion are located at the opposite sides of the base portion. A receiving space is defined by the insulating housing and the cover. One end of the cable and the contacts are received and connected electrically in the receiving space. One side of the cable connector assembly comprises a hole, and the cable extends out of the receiving space through the hole.

However, a number of drawbacks have been found in the '459 patent. For example, the insulating housing is shaped as an L in its side elevation, i.e., relatively high. Hence, it is not suitable for compact, short electronic devices. Moreover, the insulating housing is not resistant to shock when it is subjected to strong external force exerted thereupon.

Notwithstanding the prior art, the invention is neither taught nor rendered obvious thereby.

SUMMARY OF THE INVENTION

It is therefore an object of the invention to provide an electrical connector comprising an FFC electrically connected to an electrical cable, a connector housing covering a rear portion of the FFC and a front end of the electrical cable for fastening the FFC and the electrical cable, and a protective plastic plate provided in a front portion of the FFC so that a plurality of contact portions of the FFC can be served as electrical terminals.

First advantage by the electrical connector of the invention is detailed below. Height of the electrical connector can be ideally reduced by inserting the plurality of contact portions of the FFC into electrical terminals in a mating connector.

Second advantages provided by the electrical connector of the invention are detailed below. A shock absorbing can be effectively obtained by the FFC when shock is generated or strong external force is applied to the coupled electrical connector and the mating connector. The bending nature of the electrical cable of the present invention can surely accommodate the electrical connector in a space limiting environment.

It is a first aspect of the invention to provide an electrical connector comprising an FFC comprising a first insulating layer including a plurality of internal flat conductors each being elongated and having an exposed contact portion at one end and an exposed soldering portion at the other end; an electrical cable comprising a plurality of conductors each having a second insulating layer therearound, the conductors electrically connected to the soldering portions of the FFC; and a connector housing covering a rear portion of the FFC and a front end of the electrical cable for fastening the FFC and the electrical cable; wherein a front portion of the FFC is provided with a protective plastic plate for firmly fastening and supporting the contact portions of the FFC and the first insulating layer.

It is a second aspect of the invention to provide an electrical connector comprising an FFC comprising a first insulating layer including a plurality of internal flat conductors each being elongated and having an exposed contact portion at one end and an exposed soldering portion at the other end; an electrical cable comprising a plurality of conductors each having a second insulating layer therearound, the conductors electrically connected to the soldering portions of the FFC; a spacer comprising a plurality of parallel grooves on a top surface for clamping the second insulating layers of the electrical cable; and a connector housing a covering a rear portion of the FFC and a front end of the electrical cable, the connector housing a comprising a base and a top shell releasably secured to the base; wherein the base comprises a top recess for anchoring the spacer therein; and wherein a front portion of the FFC is provided with a protective plastic plate for firmly fastening and supporting the contact portions of the FFC and the first insulating layer.

It is a third aspect of the invention to provide an electrical connector comprising an FFC comprising a first insulating layer including a plurality of internal flat conductors each being elongated and having an exposed contact portion at one end and an exposed soldering portion at the other end; a protective plastic plate provided in front of the FFC for fastening and supporting the contact portions of the FFC and the first insulating layer; an electrical cable comprising a plurality of conductors each having a second insulating layer therearound, the conductors electrically connected to the soldering portions of the FFC; and a connector housing covering a rear portion of the FFC and a front end of the electrical cable, the connector housing comprising a base and a top shell releasably secured to the base; wherein at least one projection is formed on a rear portion of the protective plastic plate, the base comprises at least one first stop members for limiting movement of projections toward one direction.

The above and other objects, features and advantages of the invention will become apparent from the following detailed description taken with the accompanying drawings.

DETAILED DESCRIPTION OF THE INVENTION

Figure 1:
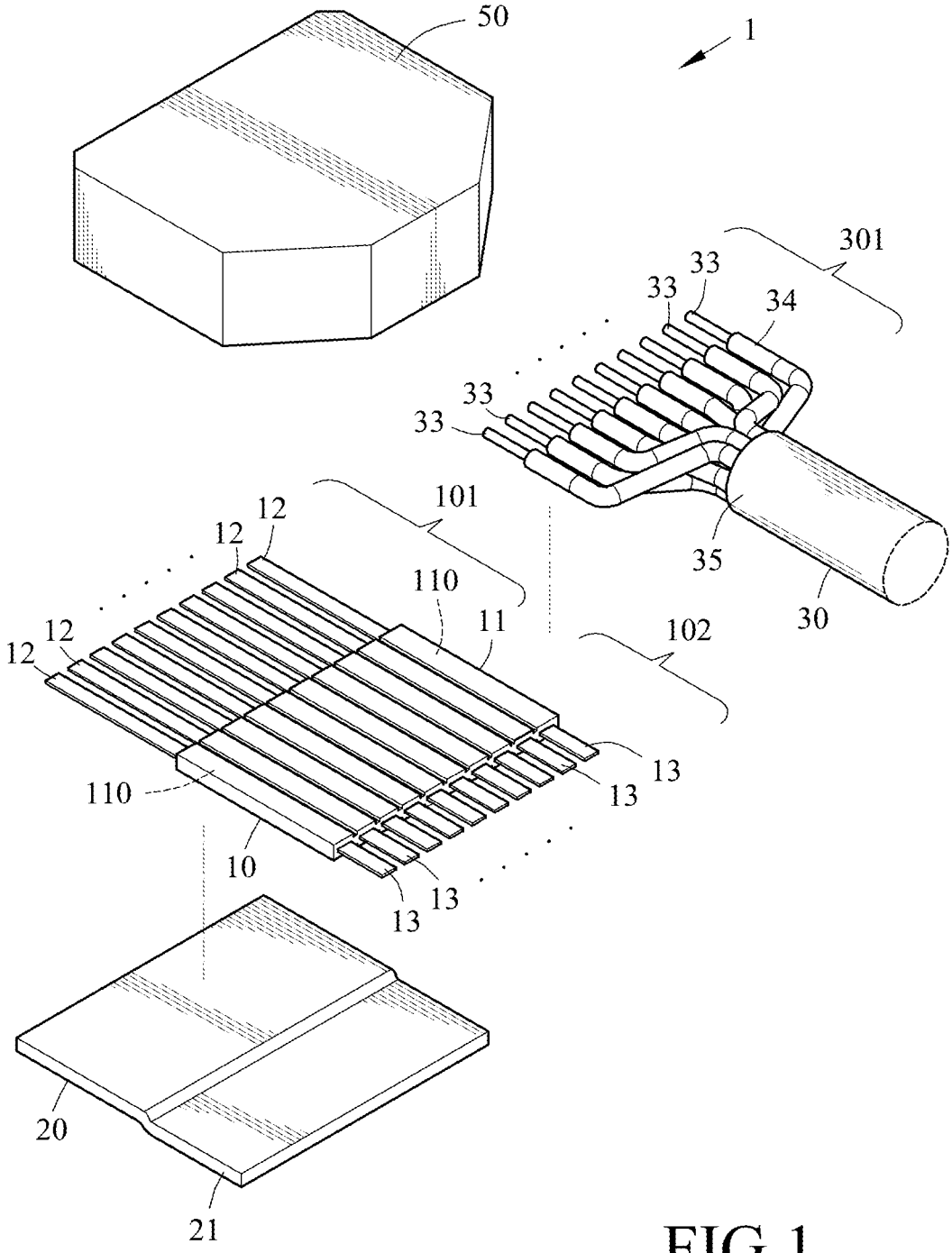
FIG. 1 is an exploded view of an electrical connector according to a first preferred embodiment of the invention.
Figure 2:
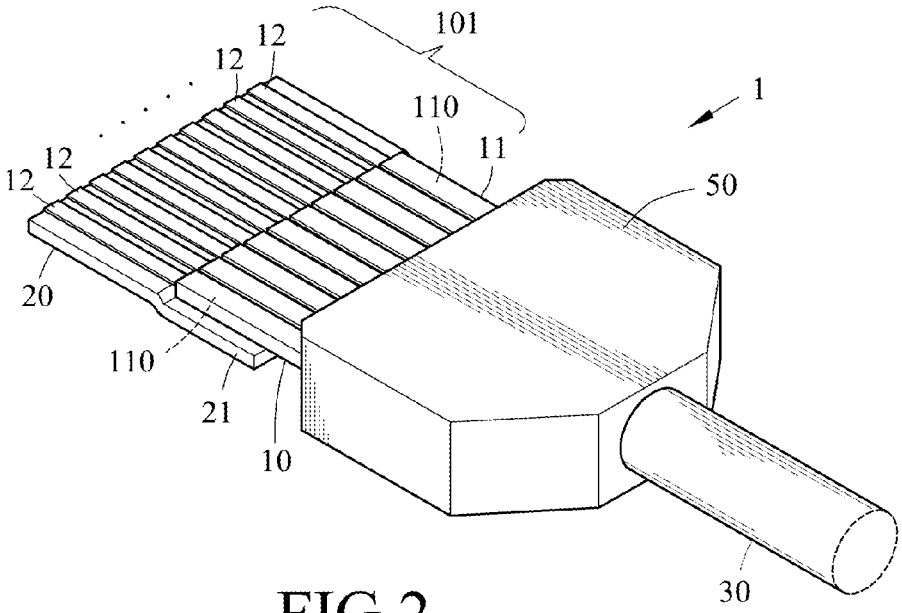
FIG. 2 is a perspective view of the assembled electrical connector of FIG. 1.

Referring to FIGS. 1 and 2, an electrical connector 1 in accordance with a first preferred embodiment of the invention comprises an FFC (flex flat cable) 10, a cylindrical electrical cable 30, and a connector housing 50. The FFC 10 comprises a rectangular first insulating layer 11 including a plurality of internal flat conductors 110 such as flat copper cables coated with tin, flat copper cables coated with gold, flat metal cables coated with tin, or flat metal cables coated with gold. Each flat conductor 110 is elongated and has a contact portion 12 at one end and a soldering portion 13 at the other end both not covered by the first insulating layer 11. The electrical cable 30 comprises a plurality of conductors 33 each having a cylindrical second insulating layer 34 therearound. The conductors 33 are electrically connected to the soldering portions 13. The connector housing 50 is provided to cover a rear portion 102 of the FFC 10 and a front end 301 of the electrical cable 30. For example, the connector housing 50 is formed of overmolding for covering both the rear portion 102 of the FFC 10 and the front end 301 of the electrical cable 30. A front portion 101 of the FFC 10 is provided with a protective plastic plate 20, i.e., the protective plastic plate 20 adhered to the contact portions 12 and the first insulating layer 11 from below. Thus, the contact portions 12 and the first insulating layer 11 can be fastened and supported by the protective plastic plate 20.

Figure 3:
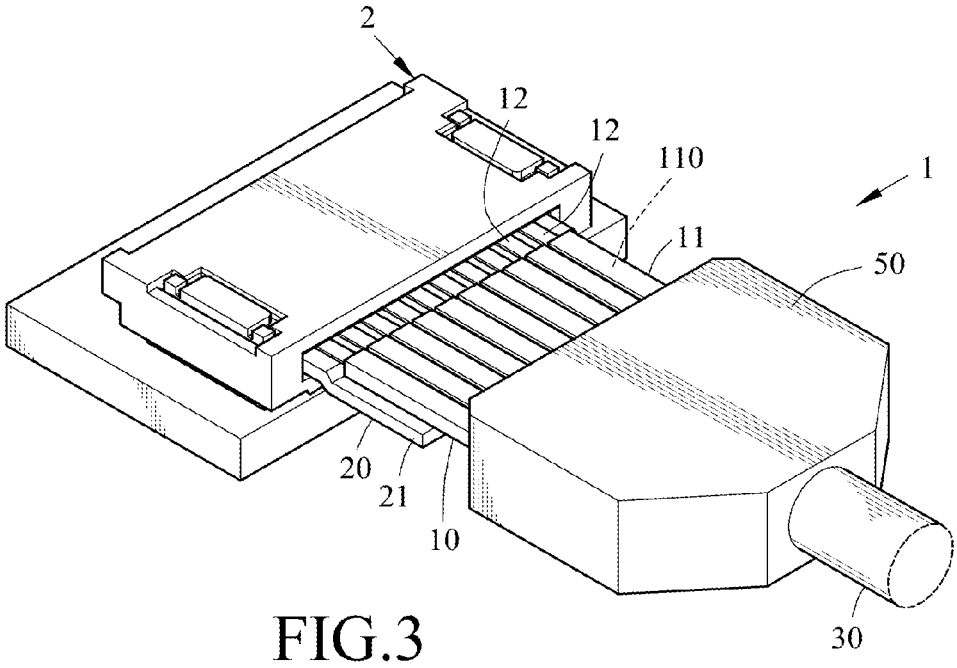
FIG. 3 is a perspective view of the electrical connector of FIG. 2 connected to a mating connector.

Referring to FIG. 3, in the first preferred embodiment a rear portion 21 of the protective plastic plate 20 is disposed in front of the connector housing 50. The contact portions 12 of the FFC 10 connect to electrical terminals (not shown) in a mating connector 2 by insertion when the electrical connector 1 is connected to the mating connector 2. Thus, the electrical connector 1 and the mating connector 2 can be electrically connected together and in turn, height of the electrical connector 1 can be reduced. A shock absorbing effect can be obtained by the FFC 10 when shock is generated or strong external force is applied to the coupled electrical connector 1 and the mating connector 2. The bending nature of the electrical cable 30 can accommodate the electrical connector 1 in a space limiting environment.

Figure 4:
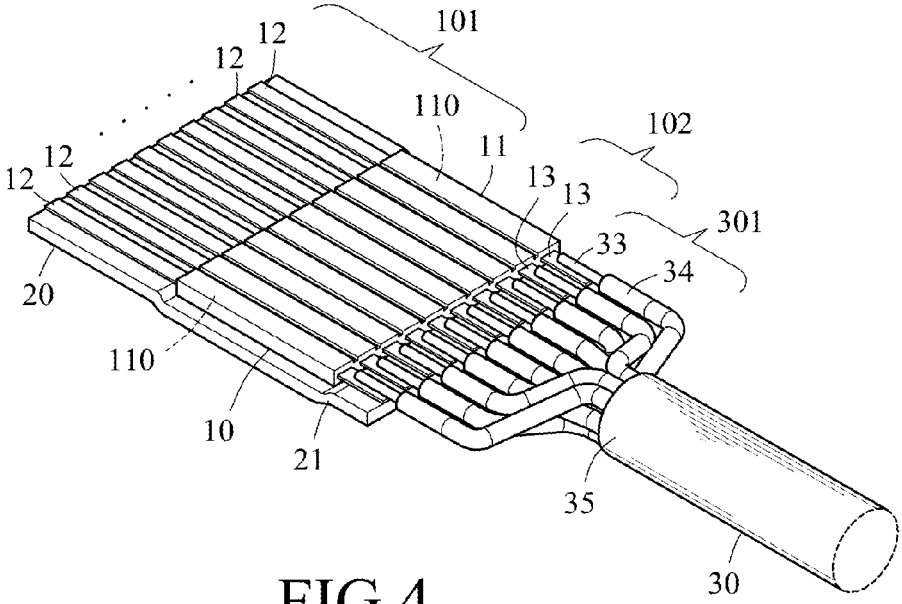
FIG. 4 is a perspective view of an electrical connector according to a second preferred embodiment of the invention with the cover removed.
Figure 5:
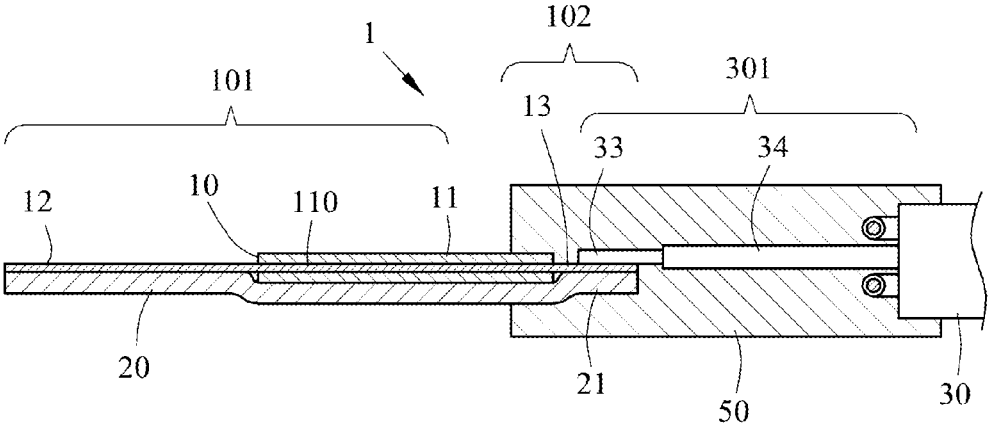
FIG. 5 is a longitudinal sectional view of the assembled electrical connector of FIG. 4 and the cover.

Referring to FIGS. 4 and 5, an electrical connector 1 in accordance with a second preferred embodiment of the invention is shown. The characteristics of the second preferred embodiment are substantially the same as that of the first preferred embodiment except the following: A rear portion 21 of the protective plastic plate 20 is fastened in the connector housing 50. Alternatively, the rear portion 21 of the protective plastic plate 20 extends to dispose in the rear portion 102 of the FFC 10 so that the protective plastic plate 20 may adhere to the contact portions 12, the first insulating layer 11, and the soldering portions 13. Thus, the contact portions 12, the first insulating layer 11, and the soldering portions 13 can be fastened and supported by the protective plastic plate 20. The rear portion 21 of the protective plastic plate 20 is fastened in the connector housing 50.

Figure 4A:
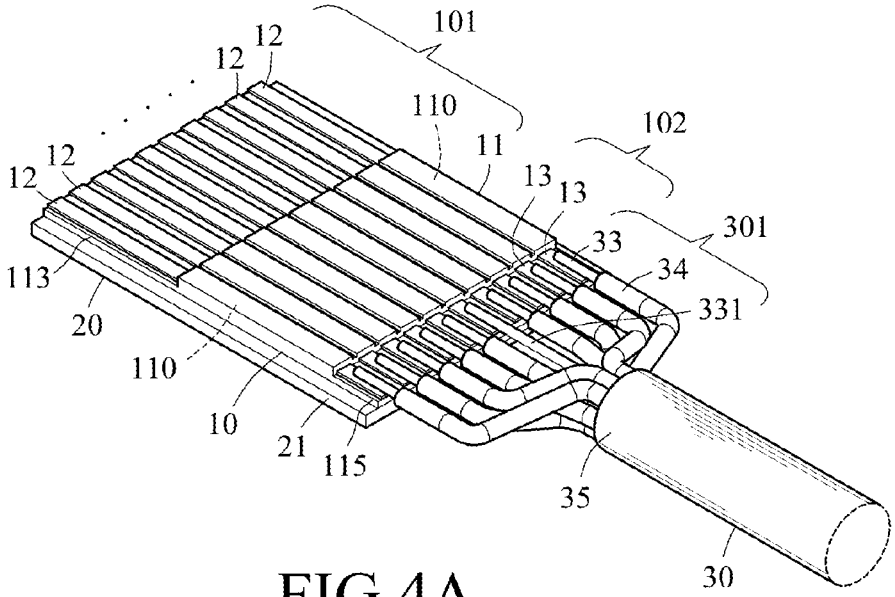
FIG. 4A is a view similar to FIG. 4 showing another configuration of the second preferred embodiment.
Figure 5A:
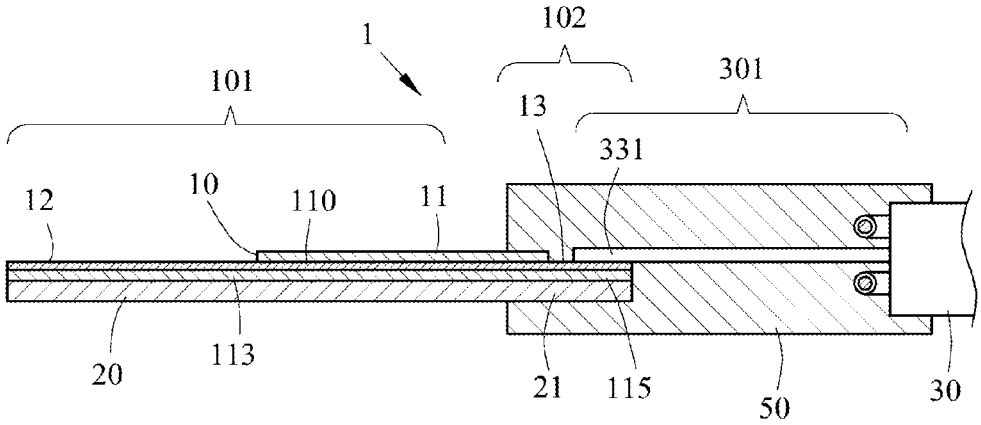
FIG. 5A is a longitudinal sectional view of the assembled electrical connector of FIG. 4A and the cover.

Referring to FIGS. 4A and 5A, in another configuration of the second preferred embodiment the first insulating layer 11 of the FFC 10 comprises a first extension 113 at one end and a second extension 115 at the other end. The first extension 113 adheres to the contact portions 12 and the second extension 115 adheres to the soldering portions 13. Thus, the protective plastic plate 20 adheres to the first extension 113, the first insulating layer 11, and the second extension 115. The electrical cable 30 comprises a ground terminal 331 electrically connected to the conductors 33 in another configuration.

Figure 6:
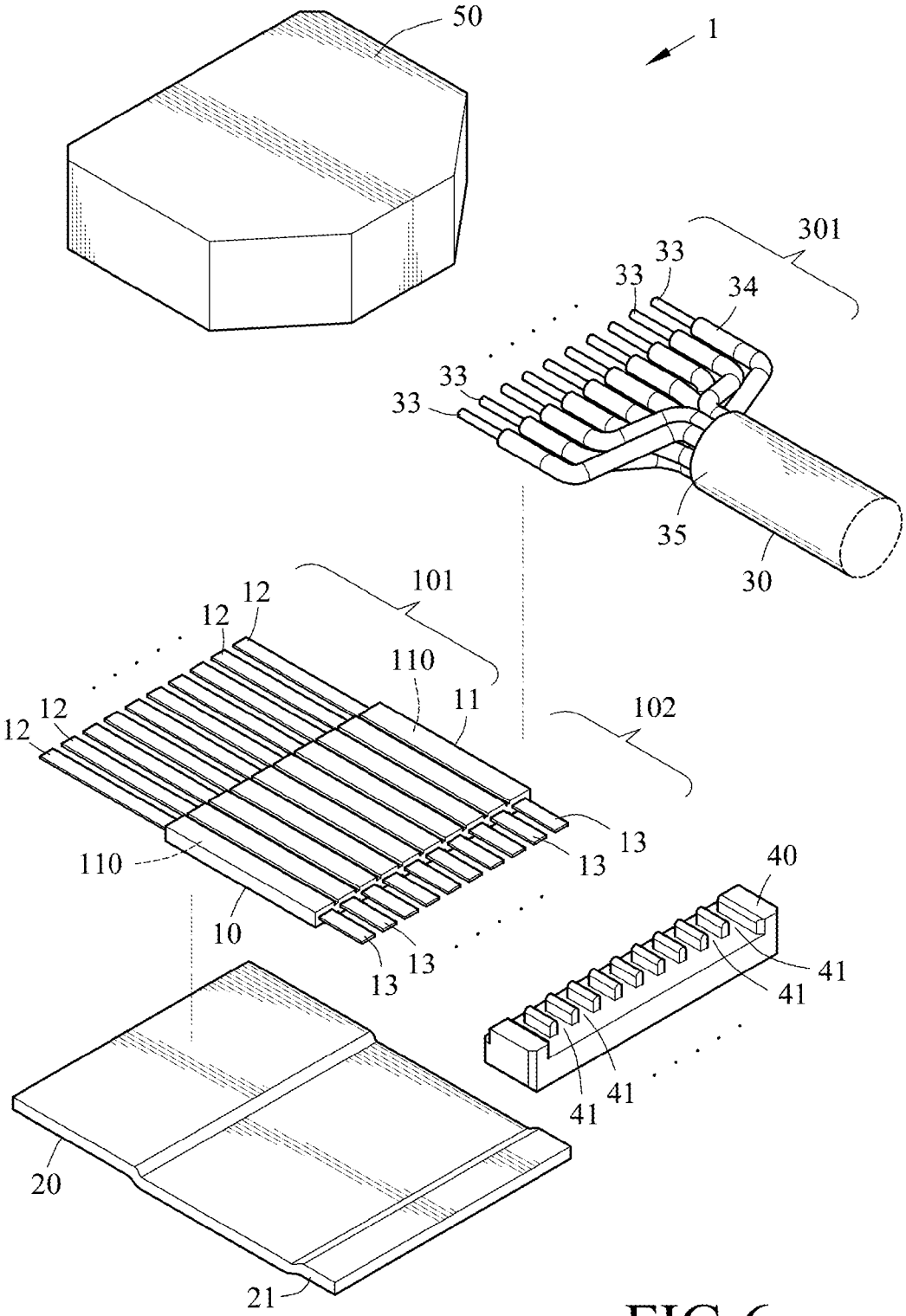
FIG. 6 is an exploded view of an electrical connector according to a third preferred embodiment of the invention.
Figure 7:
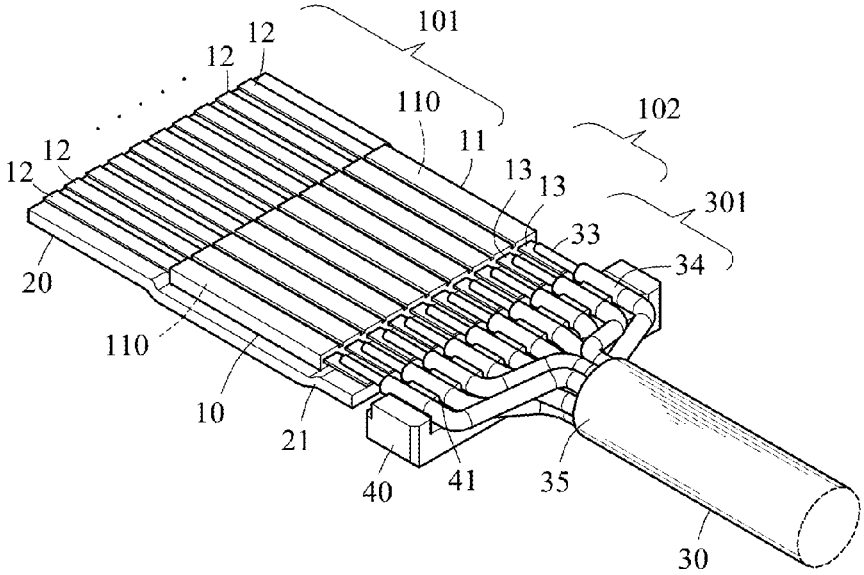
FIG. 7 is an exploded perspective view of the electrical connector of FIG. 6.
Figure 8:
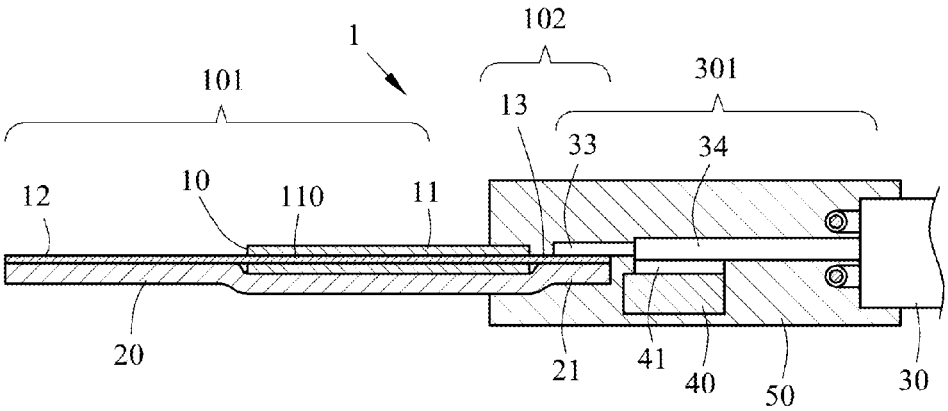
FIG. 8 is a longitudinal sectional view of the assembled electrical connector of FIG. 6.

Referring to FIGS. 6, 7 and 8, an electrical connector 1 in accordance with a third preferred embodiment of the invention is shown. The characteristics of the third preferred embodiment are substantially the same as that of the second preferred embodiment except the following: A spacer 40 is provided below the front end 301 of the electrical cable 30. The spacer 40 comprises a plurality of parallel grooves 41 on a top surface for clamping a plurality of second insulating layers 34 of the electrical cable 30. Further, the electrical cable 30 comprises a cylindrical third insulating layer 35 surrounding portions of the second insulating layers 34.

Referring to FIGS. 9 to 12, an electrical connector 1*a* in accordance with a fourth preferred embodiment of the invention is shown. The characteristics of the fourth preferred embodiment are detailed below. The electrical connector 1*a* comprises an FFC 10, a cylindrical electrical cable 30, and a connector housing 50*a*. The FFC 10 comprises a rectangular first insulating layer 11 including a plurality of internal flat conductors 110. Each flat conductor 110 is elongated and has a contact portion 12 at one end and a soldering portion 13 at the other end both not covered by the first insulating layer 11. The electrical cable 30 comprises a plurality of conductors 33 each having a cylindrical second insulating layer 34 therearound. The conductors 33 are electrically connected to the soldering portions 13. A spacer 40 comprises a plurality of parallel grooves 41 on a top surface for clamping the plurality of second insulating layers 34 of the electrical cable 30. The connector housing 50*a* is provided to cover a rear portion 102 of the FFC 10 and a front end 301 of the electrical cable 30. The connector housing 50*a* comprises a base 51 and a top shell 52 releasably secured to the base 51. A front portion 101 of the FFC 10 is provided with a protective plastic plate 20, i.e., the protective plastic plate 20 adhered to the contact portions 12 and the first insulating layer 11 from below. Thus, the contact portions 12 and the first insulating layer 11 can be fastened and supported by the protective plastic plate 20. The base 51 comprises a rectangular recess 54 on top for anchoring the spacer 40 therein. The electrical cable further comprises a cylindrical third insulating layer 35 surrounding the second insulating layers 34. The top shell 52 of the connector housing 50*a* comprises two latching arms 523 on the bottom edges adapted to receive in a force-fit into two dimensioned latch-receiving recesses 513 on the bottom edges of the base 51. Further, the top shell 52 comprises two cavities 525 on two downward depending legs respectively and the base 51 further comprises two peripheral latches 515 adapted to receive in a force-fit into the cavities 525. As a result, the top shell 52 and the base 51 can be secured together in an interlocking manner. Moreover, the top shell 52 further comprises a recessed portion 53 on top and the base 51 further comprises a recessed portion 53 on bottom respectively for ease of holding by the hand.

Figure 9:
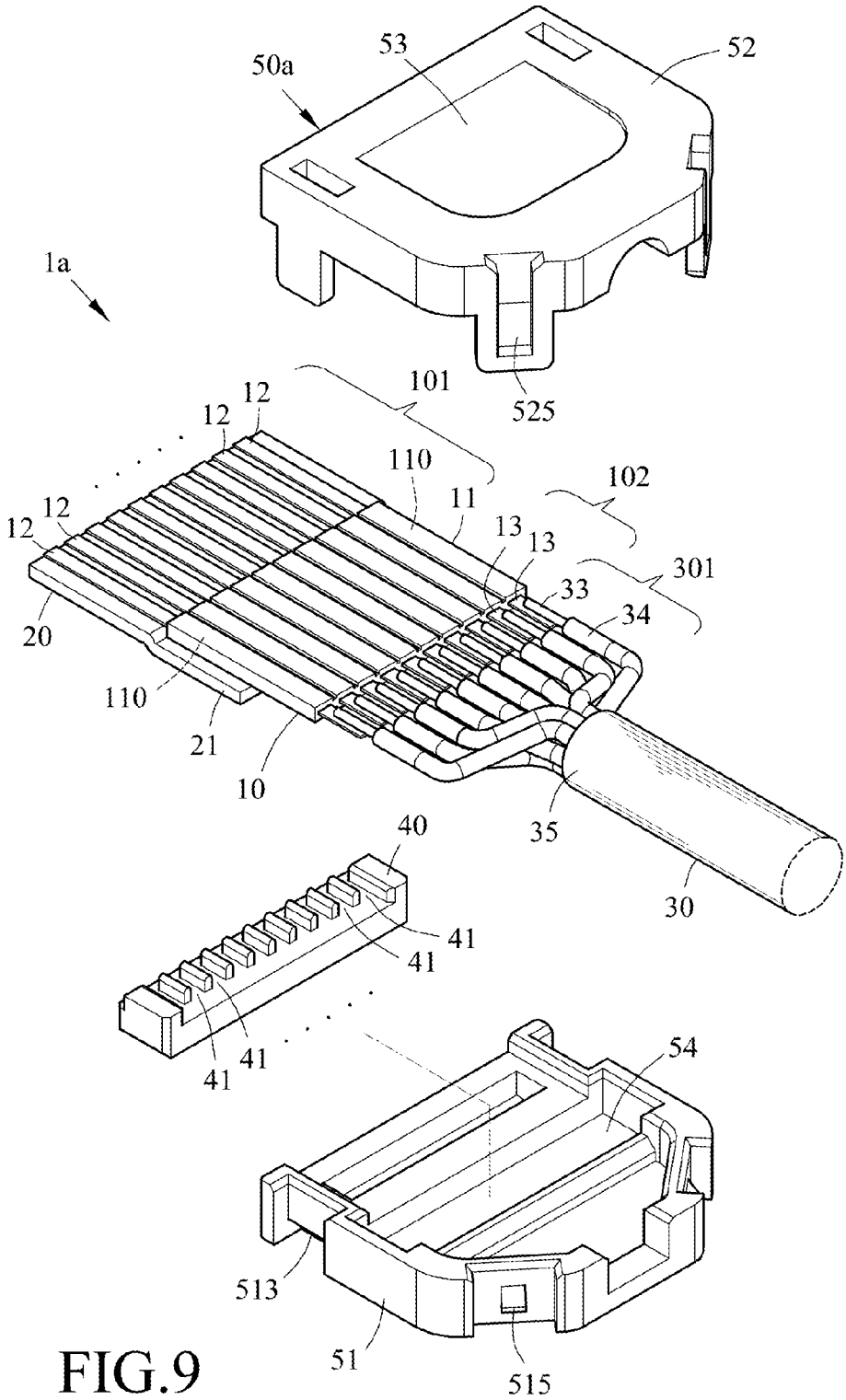
FIG. 9 is an exploded view of an electrical connector according to a fourth preferred embodiment of the invention.
Figure 9A:
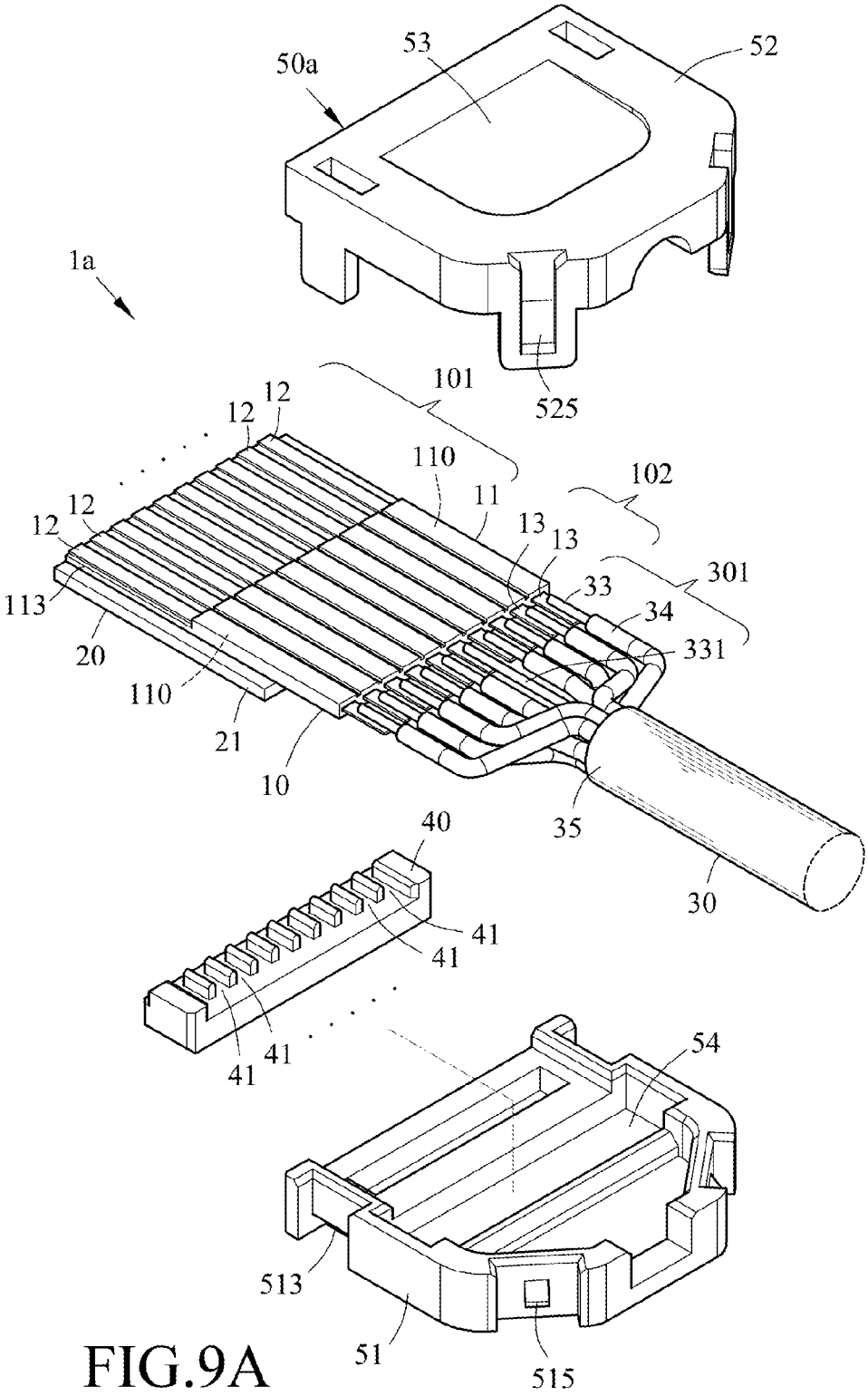
FIG. 9A is a view similar to FIG. 9 showing another configuration of the fourth preferred embodiment.
Figure 10:
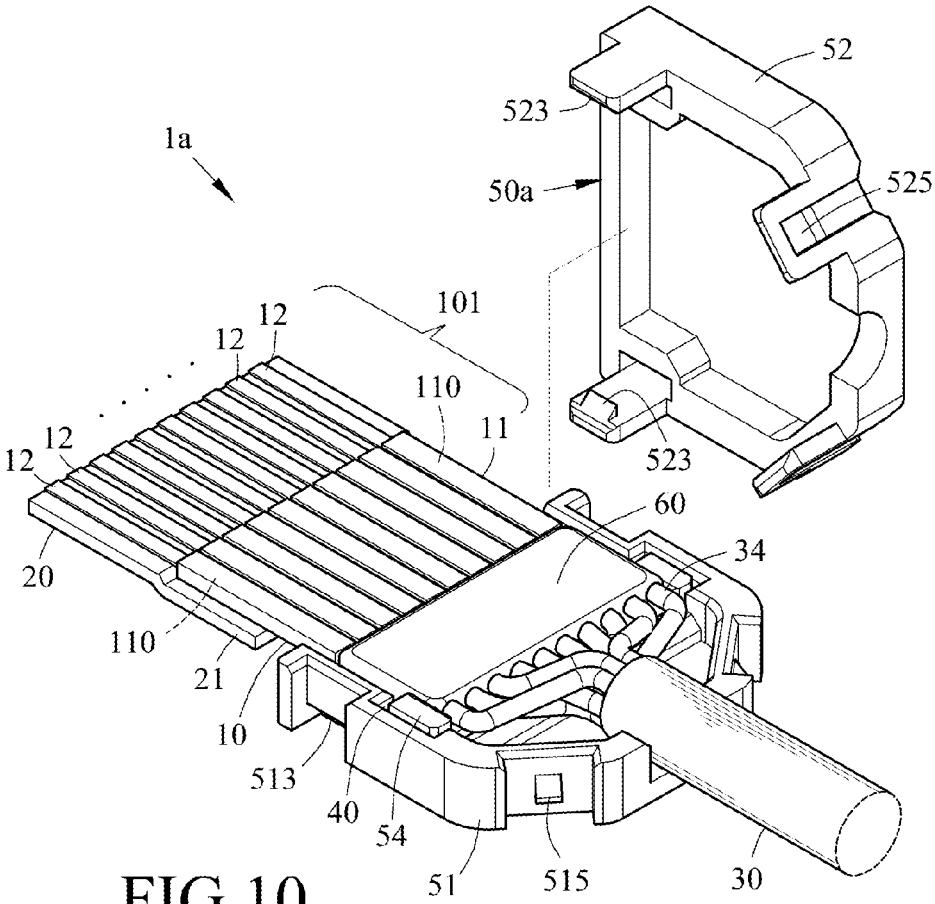
FIG. 10 an exploded perspective view of the assembled electrical connector of FIG. 9 with the covered detached.
Figure 11:
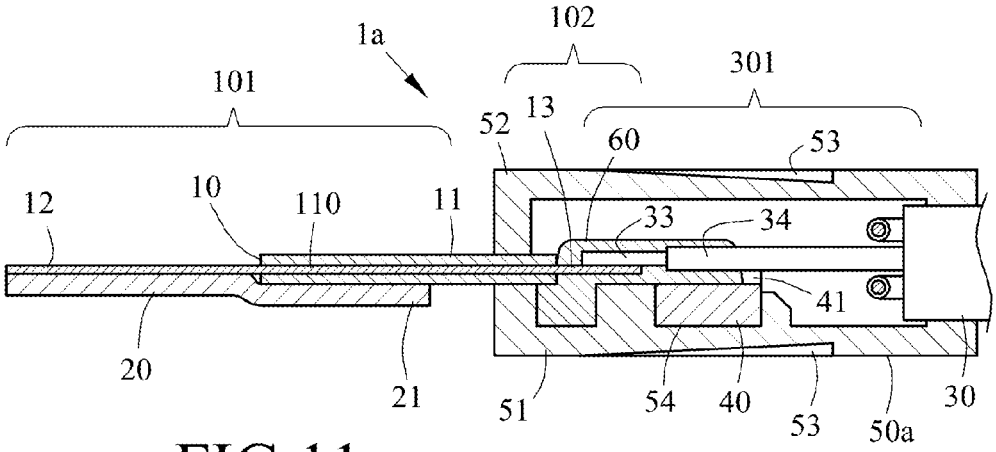
FIG. 11 is a longitudinal sectional view of the assembled electrical connector of FIG. 9.
Figure 12:
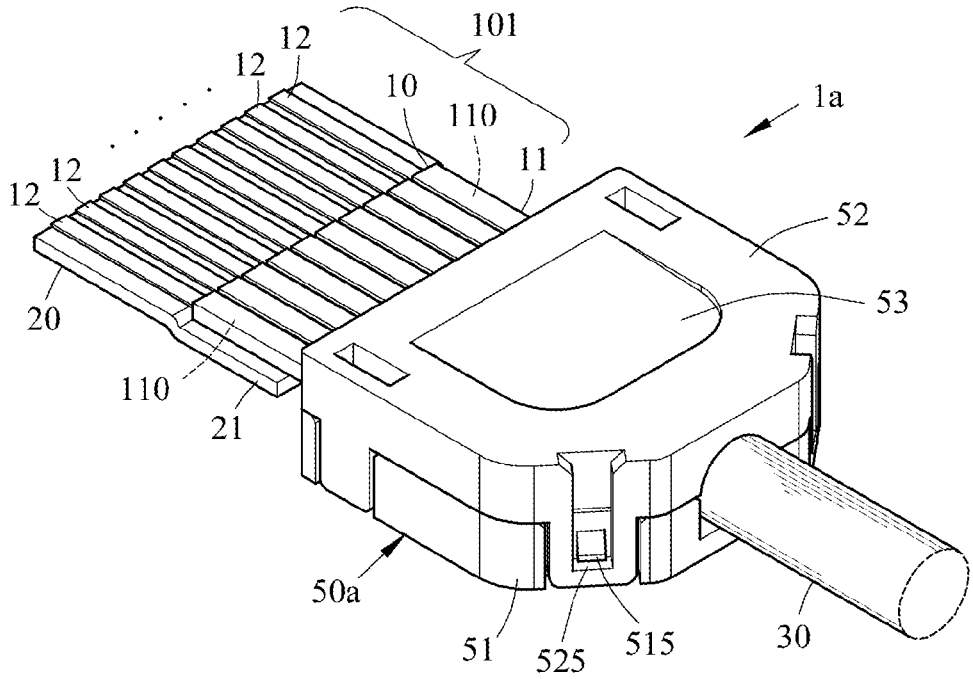
FIG. 12 is a perspective view of the assembled electrical connector of FIG. 9.

Referring to FIG. 9A, in another configuration of the fourth preferred embodiment the first insulating layer 11 of the FFC 10 comprises a first extension 113 at one end. The first extension 113 adheres to the contact portions 12. Thus, the protective plastic plate 20 adheres to the first extension 113 and the first insulating layer 11. The electrical cable 30 comprises a ground terminal 331 electrically connected to the conductors 33 at the soldering portions 13 in another configuration.

Referring to FIGS. 9 to 11 again, in the fourth preferred embodiment the rear portion 21 of the protective plastic plate 20 is disposed externally of the connector housing 50*a*. For example, the rear portion 102 of the FFC 10 is fastened in the connector housing 50*a* and the rear portion 102 of the protective plastic plate 20 is not fastened in the connector housing 50*a*. A rectangular adhesive member 60 is formed on a region covering the soldering portions 13 and the spacer 40 by coating for increasing the fastening of the soldering portions 13, the conductors 33, the second insulating layers 34, and the spacer 40. The adhesive member 60 is formed of AB adhesive, UV adhesive, hot melt type adhesive, quick dry adhesive, silicone adhesive, acrylate acid based adhesive, hot melt type inorganic adhesive, or the like for protecting the soldering portions 13, the conductors 33, and the second insulating layers 34.

Figure 13:
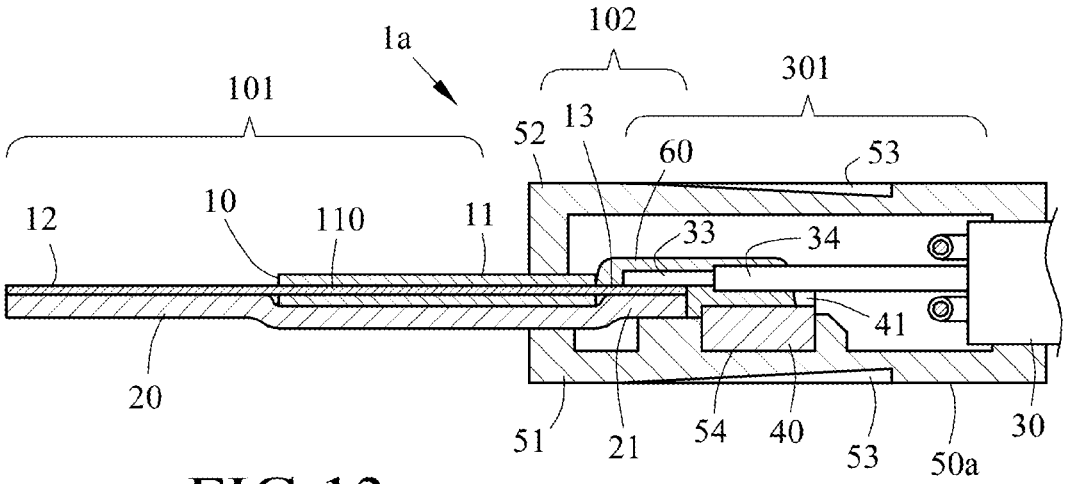
FIG. 13 is a longitudinal sectional view of an electrical connector according to a fifth preferred embodiment of the invention.

Referring to FIG. 13, an electrical connector 1*a* in accordance with a fifth preferred embodiment of the invention is shown. The characteristics of the fifth preferred embodiment are substantially the same as that of the fourth preferred embodiment except the following: The rear portion 21 of the protective plastic plate 20 is fastened in the connector housing 50*a*. For example, both the rear portion 102 of the FFC 10 and the rear portion 102 of the protective plastic plate 20 are fastened in the connector housing 50*a*. A rear portion 21 of the protective plastic plate 20 extends below the rear portion 102 of the FFC 10 to adhere to the contact portions 12, the first insulating layer 11, and the soldering portions 13 from below. Thus, the contact portions 12, the first insulating layer 11, and the soldering portions 13 can be fastened and supported by the protective plastic plate 20. Further, the rear portion 21 of the protective plastic plate 20 is fastened in the connector housing 50*a*.

Figure 14:
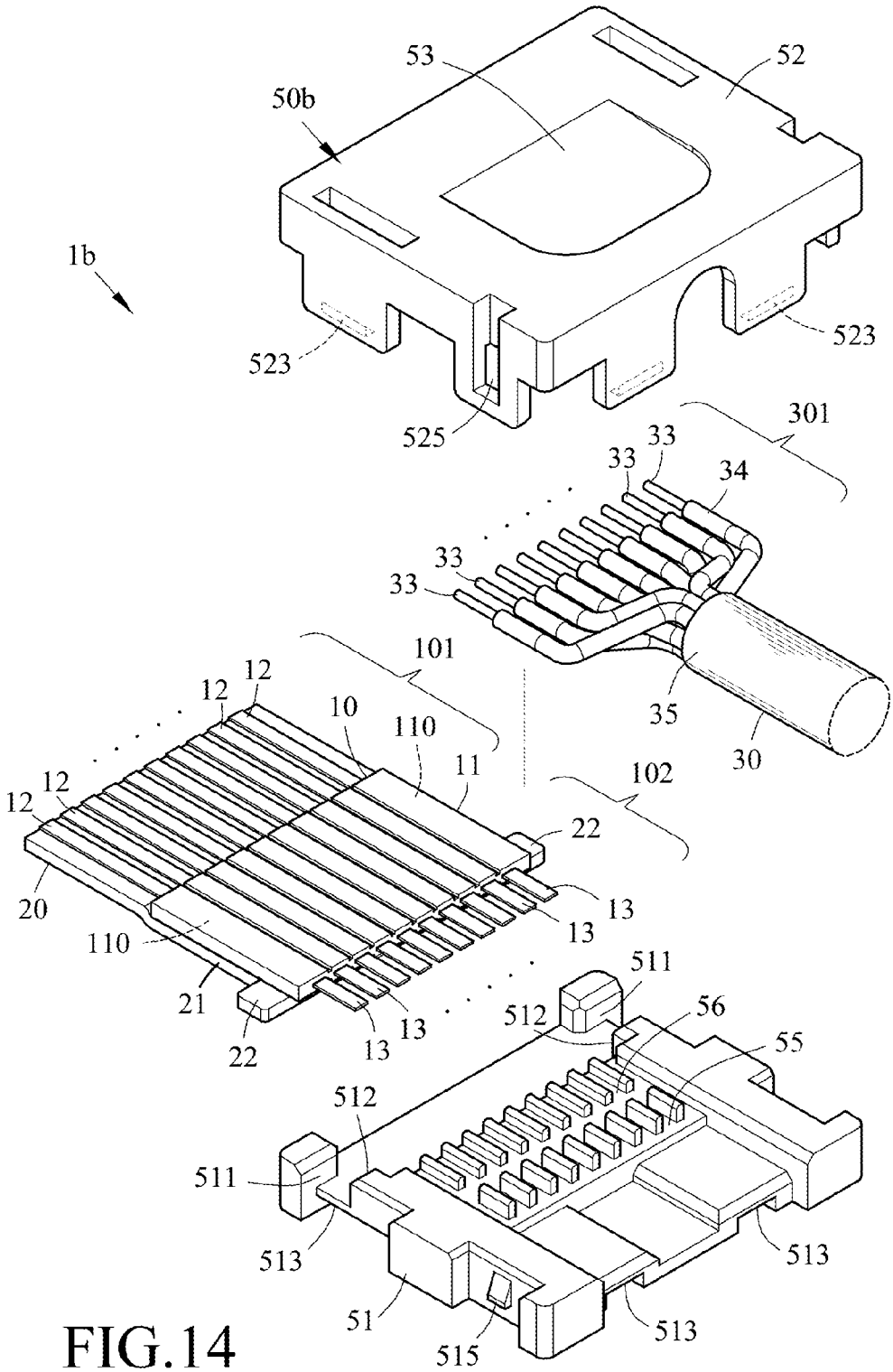
FIG. 14 is an exploded view of an electrical connector according to a sixth preferred embodiment of the invention.
Figure 15:
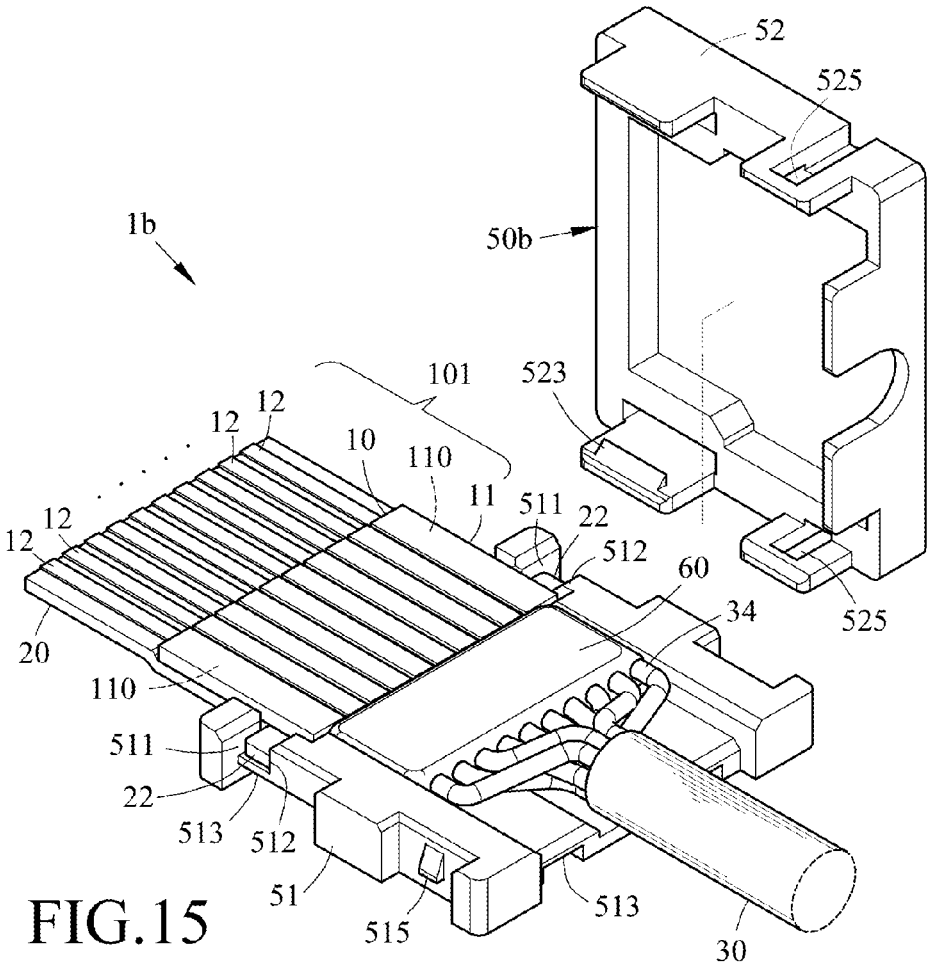
FIG. 15 is an exploded perspective view of the assembled electrical connector of FIG. 14 with the covered detached.
Figure 16:
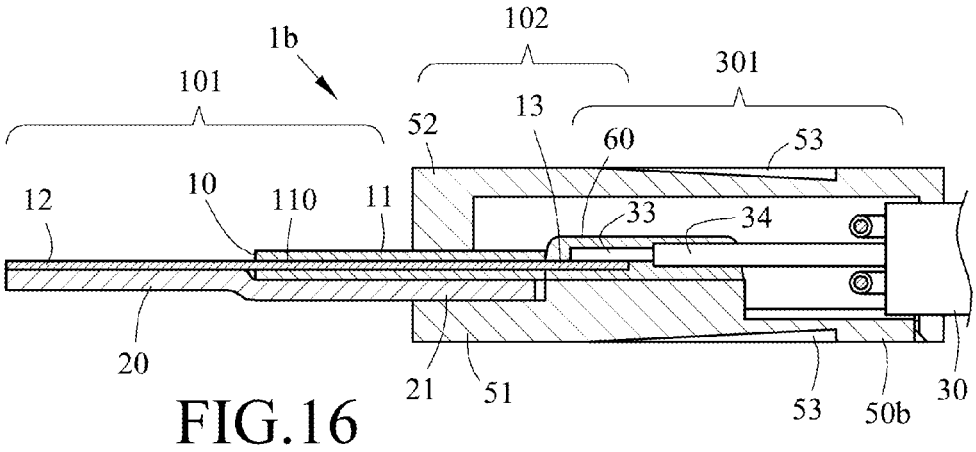
FIG. 16 is a longitudinal sectional view of the assembled electrical connector of FIG. 15.

Referring to FIGS. 14 to 16, an electrical connector 1*b* in accordance with a sixth preferred embodiment of the invention is shown. The characteristics of the sixth preferred embodiment are detailed below. The electrical connector 1*b* comprises an FFC 10, a cylindrical electrical cable 30, and a connector housing 50*b*. The FFC 10 comprises a rectangular first insulating layer 11 including a plurality of internal flat conductors 110. Each flat conductor 110 is elongated and has a contact portion 12 at one end and a soldering portion 13 at the other end both not covered by the first insulating layer 11. The protective plastic plate 20 adheres to the contact portions 12 and the first insulating layer 11 from below. The electrical cable 30 comprises a plurality of conductors 33 each having a cylindrical second insulating layer 34 therearound. The conductors 33 are electrically connected to the soldering portions 13. The connector housing 50*b* is provided to cover a rear portion 102 of the FFC 10 and a front end 301 of the electrical cable 30. The connector housing 50*b* comprises a base 51 and a top shell 52 releasably secured to the base 51. Two opposite projections 22 are formed on both sides of a rear portion 21 of the protective plastic plate 20 respectively. The base 51 comprises two first stop members 511 on two front corners respectively for limiting the movement of projections 22 toward one direction. For example, the first stop members 511 can prevent the projections 22 from moving forward. The base 51 further comprises two second stop members 512 on two intermediate portions of both sides respectively for limiting the movement of projections 22 toward the other opposite direction. For example, the second stop members 512 can prevent the projections 22 from moving rearward. The base 51 further comprises a plurality of parallel first grooves 55 on a top surface for clamping the plurality of second insulating layers 34 of the electrical cable 30. Further, an adhesive member 60 is formed on the first grooves 55 by coating for increasing the fastening of the second insulating layers 34 and the first grooves 55. On the top surface of the base 51 there are further provided a plurality of parallel second grooves 56 which are spaced from the first grooves 55 and aligned therewith. The soldering portions 13 of the FFC 10 are anchored in the second grooves 56. Moreover, an adhesive member 60 is formed on the soldering portions 13 by coating for increasing the fastening of the soldering portions 13 and the second grooves 56.

Figure 14A:
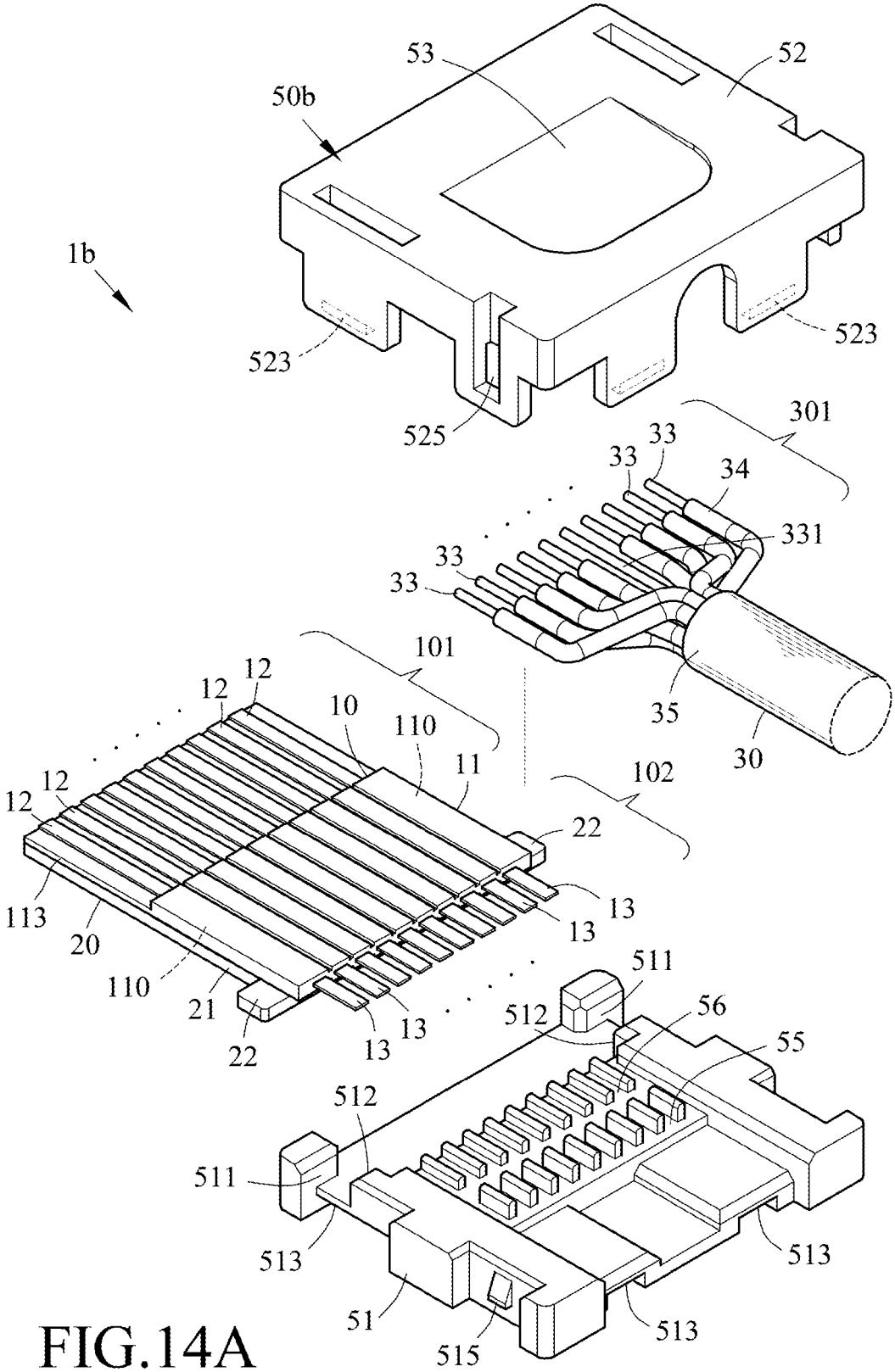
FIG. 14A is a view similar to FIG. 14 showing another configuration of the sixth preferred embodiment.

As shown in FIG. 14A, in another configuration of the sixth preferred embodiment the first insulating layer 11 of the FFC 10 comprises a first extension 113 at one end adhered to the contact portions 12. Thus, the protective plastic plate 20 adheres to the first extension 113 and the first insulating layer 11. The electrical cable 30 comprises a ground terminal 331 electrically connected to the conductors 33 at the soldering portions 13 in another configuration.

As shown in FIGS. 14 to 15 again, in the sixth preferred embodiment the electrical cable 30 further comprises a cylindrical third insulating layer 35 surrounding portions of the second insulating layers 34. The third insulating layer 35 is clamped by the top shell 52 and the base 51 of the connector housing 50 from opposite directions. The top shell 52 of the connector housing 50*b* comprises two latching arms 523 on the bottom edges adapted to receive in a force-fit into two dimensioned latch-receiving recesses 513 on the bottom edges of the base 51. Further, the top shell 52 comprises two cavities 525 on two downward depending legs respectively and the base 51 further comprises two peripheral latches 515 adapted to receive in a force-fit into the cavities 525. As a result, the top shell 52 and the base 51 can be secured together in an interlocking manner. Moreover, the top shell 52 further comprises a recessed portion 53 on top and the base 51 further comprises a recessed portion 53 on bottom respectively for ease of holding by the hand.

As shown in FIG. 16, in the sixth preferred embodiment the rear portion 102 of the FFC 10 and the rear portion 21 of the protective plastic plate 20 are fastened in the connector housing 50*b* by securing the top shell 52 to the base 51 in an interlocking manner.

While the invention has been described in terms of preferred embodiments, those skilled in the art will recognize that the invention can be practiced with modifications within the spirit and scope of the appended claims.

What is claimed is:

1. An electrical connector comprising:

an FFC (10) comprising a first insulating layer (11) including a plurality of internal flat conductors (110) each being elongated and having an exposed contact portion (12) at one end and an exposed soldering portion (13) at the other end;

an electrical cable (30) comprising a plurality of conductors (33) each having a second insulating layer (34)

therearound, the conductors (33) electrically connected to the soldering portions (13) of the FFC (10); and a connector housing (50) covering a rear portion (102) of the FFC (10) and a front end (301) of the electrical cable (30) for fastening the FFC (10) and the electrical cable (30);

wherein a front portion (101) of the FFC (10) is provided with a protective plastic plate (20) for fastening and supporting the contact portions (12) of the FFC (10) and the first insulating layer (11).

2. The electrical connector of claim 1, wherein the protective plastic plate (20) adheres to the contact portions (12) of the FFC (10) and the first insulating layer (11), and wherein the connector housing (50) is formed of over-molding for covering both the rear portion (102) of the FFC (10) and the front end (301) of the electrical cable (30).

3. The electrical connector of claim 1, wherein the first insulating layer (11) of the FFC (10) comprises a first extension (113) at one end and a second extension (115) at the other end, the first extension (113) adheres to the contact portions (12) of the FFC (10), the second extension (115) adheres to the soldering portions (13) of the FFC (10), and the protective plastic plate (20) adheres to the first extension (113) of the FFC (10), the first insulating layer (11), and the second extension (115).

4. The electrical connector of claim 1, wherein a rear portion (21) of the protective plastic plate (20) is disposed externally of the connector housing (50), and further comprising a spacer (40) disposed below the front end (301) of the electrical cable (30), the spacer (40) including a plurality of parallel grooves (41) on a top surface for clamping the second insulating layers (34) of the electrical cable (30).

5. The electrical connector of claim 1, wherein the rear portion (21) of the protective plastic plate (20) extends to dispose in the rear portion (102) of the FFC (10) so that the protective plastic plate (20) adheres to the contact portions (12), the first insulating layer (11), and the soldering portions (13), and wherein the rear portion (21) of the protective plastic plate (20) is fastened in the connector housing (50).

6. An electrical connector comprising:

an FFC (10) comprising a first insulating layer (11) including a plurality of internal flat conductors (110) each being elongated and having an exposed contact portion (12) at one end and an exposed soldering portion (13) at the other end;

an electrical cable (30) comprising a plurality of conductors (33) each having a second insulating layer (34) therearound, the conductors (33) electrically connected to the soldering portions (13) of the FFC (10);

a spacer (40) comprising a plurality of parallel grooves (41) on a top surface for clamping the second insulating layers (34) of the electrical cable (30); and a connector housing (50*a*) covering a rear portion (102) of the FFC (10) and a front end (301) of the electrical cable (30), the connector housing (50*a*) comprising a base (51) and a top shell (52) releasably secured to the base (51);

wherein the base (51) comprises a top recess (54) for anchoring the spacer (40) therein; and wherein a front portion (101) of the FFC (10) is provided with a protective plastic plate (20) for fastening and supporting the contact portions (12) of the FFC (10) and the first insulating layer (11).

7. The electrical connector of claim 6, wherein the first insulating layer (11) of the FFC (10) comprises a first extension (113) at one end, the first extension (113) adheres to the contact portions (12), and the protective plastic plate (20) adheres to both the first extension (113) and the first insulating layer (11); wherein the base (51) further comprises a bottom recessed portion (53) for ease of holding and two latch-receiving recesses (513); and wherein the top shell (52) comprises a top recessed portion (53) for ease of holding and two latching arms (523) lockingly received in the latch-receiving recesses (513).

8. The electrical connector of claim 6, wherein a rear portion (21) of the protective plastic plate (20) is disposed externally of the connector housing (50*a*), wherein the rear portion (102) of the FFC (10) is fastened in the connector housing (50*a*), and wherein an adhesive member (60) is coated on the soldering portions (13) of the FFC (10) and the spacer (40).

9. The electrical connector of claim 6, wherein the rear portion (21) of the protective plastic plate (20) is fastened in the connector housing (50*a*), wherein both the rear portion (102) of the FFC (10) and the rear portion (102) of the protective plastic plate (20) are fastened in the connector housing (50*a*), and wherein an adhesive member (60) is coated on the soldering portions (13) of the FFC (10) and the spacer (40).

10. The electrical connector of claim 6, wherein the rear portion (21) of the protective plastic plate (20) extends to adhere to the contact portions (12) of the FFC (10), the first insulating layer (11), and the soldering portions (13) of the FFC (10) from below; wherein the rear portion (21) of the protective plastic plate (20) is fastened in the connector housing (50*a*); wherein an adhesive member (60) is coated on the soldering portions (13) of the FFC (10) and the spacer (40); wherein the flat conductors (110) of the FFC (10) are flat copper cables coated with tin, flat copper cables coated with gold, flat metal cables coated with tin, or flat metal cables coated with gold; and wherein the electrical cable (30) comprises a third insulating layer (35) surrounding portions of the second insulating layers (34).

11. An electrical connector comprising:

an FFC (10) comprising a first insulating layer (11) including a plurality of internal flat conductors (110) each being elongated and having an exposed contact portion (12) at one end and an exposed soldering portion (13) at the other end;

a protective plastic plate (20) provided in front of the FFC (10) for fastening and supporting the contact portions (12) of the FFC (10) and the first insulating layer (11);

an electrical cable (30) comprising a plurality of conductors (33) each having a second insulating layer (34) therearound, the conductors (33) electrically connected to the soldering portions (13) of the FFC (10); and a connector housing (50*b*) covering a rear portion (102) of the FFC (10) and a front end (301) of the electrical cable (30), the connector housing (50*b*) comprising a base (51) and a top shell (52) releasably secured to the base (51);

wherein at least one projection (22) is formed on a rear portion (21) of the protective plastic plate (20), the base (51) comprises at least one first stop members (511) for limiting movement of projections (22) toward one direction.

12. The electrical connector of claim 11, wherein the base (51) further comprises at least one second stop members (512) for limiting movement of the projections (22) toward the other opposite direction; and wherein an adhesive member (60) is coated on the soldering portions (13) of the FFC (10).

13. The electrical connector of claim 11, wherein the base (51) further comprises a plurality of parallel top first grooves (55) for clamping the second insulating layers (34) of the electrical cable (30); and wherein an adhesive member (60) is coated on the first grooves (55).

14. The electrical connector of claim 11, wherein the base (51) further comprises a plurality of parallel top second grooves (56) spaced from the first grooves (55) and aligned therewith; wherein the soldering portions (13) of the FFC (10) are anchored in the second grooves (56); and wherein an adhesive member (60) is coated on the soldering portions (13) of the FFC (10).

15. The electrical connector of claim 11, wherein the protective plastic plate (20) adheres to the contact portions (12) of the FFC (10) and the first insulating layer (11).

16. The electrical connector of claim 11, wherein the first insulating layer (11) of the FFC (10) comprises a first extension (113) at one end adhered to the contact portions (12) of the FFC (10); and wherein the protective plastic plate (20) adheres to the first extension (113) of the FFC (10) and the first insulating layer (11).

17. The electrical connector of claim 11, wherein the electrical cable (30) further comprises a ground terminal (331) electrically connected to the conductors (33) of the electrical cable (30) at the soldering portions (13) of the FFC (10); wherein the electrical cable (30) further comprises a third insulating layer (35) surrounding portions of the second insulating layers (34) of the electrical cable (30); and wherein the third insulating layer (35) is clamped by the top shell (52) and the base (51) from opposite directions.

18. The electrical connector of claim 11, wherein the top shell (52) comprises a top recessed portion (53) for ease of holding and two latching arms (523) on bottom edges; wherein the base (51) comprises a bottom recessed portion (53) for ease of holding and two latch-receiving recesses (513) for lockingly receiving the latching arms (523); and wherein the rear portion (102) of the FFC (10) and the rear portion (21) of the protective plastic plate (20) are fastened in the connector housing (50*b*) by lockingly securing the top shell (52) to the base (51).

19. The electrical connector of claim 11, wherein the top shell (52) comprises a top recessed portion (53) for ease of holding and two cavities (525); wherein the base (51) comprises a bottom recessed portion (53) for ease of holding and two latches (515) lockingly received in the cavities (525); and wherein the rear portion (102) of the FFC (10) and the rear portion (21) of the protective plastic plate (20) are fastened in the connector housing (50*b*) by lockingly securing the top shell (52) to the base (51).

* * * * *